US009488040B2

(12) United States Patent
Chakrabarty et al.

(10) Patent No.: US 9,488,040 B2
(45) Date of Patent: Nov. 8, 2016

(54) CYCLIC SOLVENT HYDROCARBON RECOVERY PROCESS USING AN ADVANCE-RETREAT MOVEMENT OF THE INJECTANT

(71) Applicants: Tapantosh Chakrabarty, Calgary (CA); Wenqiang Han, Calgary (CA)

(72) Inventors: Tapantosh Chakrabarty, Calgary (CA); Wenqiang Han, Calgary (CA)

(73) Assignee: ExxonMobil Upstream Research Company, Spring, TX (US)

( * ) Notice: Subject to any disclaimer, the term of this patent is extended or adjusted under 35 U.S.C. 154(b) by 44 days.

(21) Appl. No.: 14/480,105

(22) Filed: Sep. 8, 2014

(65) Prior Publication Data

US 2015/0152718 A1 Jun. 4, 2015

(30) Foreign Application Priority Data

Dec. 3, 2013 (CA) ..... 2836528

(51) Int. Cl.
*E21B 43/16* (2006.01)

(52) U.S. Cl.
CPC ..... *E21B 43/16* (2013.01)

(58) Field of Classification Search
CPC ..... E21B 43/16; E21B 43/2408; E21B 43/2406; E21B 43/168; E21B 43/30; E21B 43/24; E21B 43/305; E21B 43/25; E21B 43/166
See application file for complete search history.

(56) References Cited

U.S. PATENT DOCUMENTS

| | | | | |
|---|---|---|---|---|
| 2,412,765 | A | 12/1946 | Buddrus et al. | 166/21 |
| 3,954,141 | A | 5/1976 | Allen et al. | 166/274 |
| 4,008,764 | A | 2/1977 | Allen | 166/266 |
| 4,819,724 | A | 4/1989 | Bou-Mikael et al. | 166/263 |
| 5,025,863 | A | 6/1991 | Haines et al. | 166/305.1 |
| 5,407,009 | A | 4/1995 | Butler et al. | 166/266 |
| 5,607,016 | A | 3/1997 | Butler | 166/263 |
| 5,674,816 | A | 10/1997 | Loree | 507/118 |
| 5,725,054 | A | 3/1998 | Shayegi et al. | 166/263 |
| 5,771,973 | A | 6/1998 | Jensen et al. | 166/303 |

(Continued)

FOREIGN PATENT DOCUMENTS

| | | | |
|---|---|---|---|
| CA | 1015656 | 8/1977 | E21B 43/28 |
| CA | 1059432 | 7/1979 | E21B 43/00 |

(Continued)

OTHER PUBLICATIONS

ASTM (1997) "Standard Test Method for Boiling Range Distribution of Petroleum Fractions by Gas Chromatography," *ASTM*, D2887, 24 pages (2014).

(Continued)

*Primary Examiner* — Zakiya W Bates
(74) *Attorney, Agent, or Firm* — ExxonMobil Upstream Research Company Law Dept.

(57) ABSTRACT

Herein is a cyclic solvent-dominated recovery process (CSDRP) for recovering hydrocarbons from an underground reservoir. The cyclic solvent process involves using an injection well to inject a viscosity-reducing solvent into the underground reservoir. Reduced viscosity oil is produced to the surface using the same well used to inject solvent. The process of alternately injecting solvent and producing a solvent/viscous oil blend through the same well continues in a series of cycles until additional cycles are no longer economical. To contact uncovered hydrocarbons between solvent fingers, the injection includes alternating injection and production, for creating an advance-retreat movement.

13 Claims, 2 Drawing Sheets

(56) References Cited

U.S. PATENT DOCUMENTS

| | | | | |
|---|---|---|---|---|
| 6,039,116 | A | 3/2000 | Stevenson et al. | 166/263 |
| 6,318,464 | B1 | 11/2001 | Mokrys | 166/252.1 |
| 6,405,799 | B1 | 6/2002 | Vallejos et al. | 166/263 |
| 2011/0303423 | A1* | 12/2011 | Kaminsky | E21B 43/2401 166/400 |
| 2012/0234535 | A1* | 9/2012 | Dawson | E21B 43/16 166/263 |

FOREIGN PATENT DOCUMENTS

| | | | | |
|---|---|---|---|---|
| CA | 1122115 | | 4/1982 | E21B 43/28 |
| CA | 2108723 | | 4/1995 | E21B 43/24 |
| CA | 2108349 | | 8/1996 | E21B 43/24 |
| CA | 2185837 | A1 * | 3/1998 | E21B 43/16 |
| CA | 2306016 | | 11/2004 | E21B 21/08 |
| CA | 2349234 | | 12/2004 | E21B 43/22 |
| CA | 2147079 | | 10/2006 | E21B 43/16 |
| CA | 2281276 | | 2/2007 | E21B 43/24 |
| CA | 2304938 | | 2/2008 | E21B 43/24 |
| CA | 2351148 | | 7/2008 | E21B 43/24 |
| CA | 2462359 | | 5/2011 | E21B 43/24 |
| CA | 2645267 | | 4/2013 | C10G 1/04 |
| CA | 2734170 | | 9/2013 | E21B 43/12 |
| CA | 2781273 | | 5/2014 | C09K 8/592 |

OTHER PUBLICATIONS

Boberg, T.C. et al. (1966) "Calculation of the production rate of a thermally stimulated well", *JPT,* pp. 1613-1623, Dec. 1966.

Feali, M. et al. (2008) "Feasibility Study of the Cyclic VAPEX Process for Low Permeable Carbonate Systems", *International Petroleum Technology Conference Paper 12833,* 2008.

Lim, G. B. et al. (1995) "Cyclic Stimulation of Cold Lake Oil Sand with Supercritical Ethane", *SPE Paper 30298,* pp. 521-528, 1995.

Lim, G. B. et al. (1996) "Three-dimensional Scaled Physical Modeling of Solvent Vapour Extraction of Cold Lake Bitumen", *The Journal of Canadian Petroleum Technology,* 35(4), pp. 32-40, Apr. 1996.

* cited by examiner

CYCLIC SOLVENT HYDROCARBON RECOVERY PROCESS USING AN ADVANCE-RETREAT MOVEMENT OF THE INJECTANT

CROSS REFERENCE TO RELATED APPLICATIONS

This application claims priority from Canadian Patent Application number 2,836,528 which was filed on 3 Dec. 2013, entitled CYCLIC SOLVENT HYDROCARBON RECOVERY PROCESS USING AN ADVANCE-RETREAT MOVEMENT OF THE INJECTANT which is incorporated herein by reference.

FIELD

The present disclosure relates generally to the recovery of in-situ hydrocarbons. More particularly, the present disclosure relates to the use of a cyclic solvent-dominated recovery process (CSDRP) to recover in-situ hydrocarbons including bitumen.

BACKGROUND

At the present time, solvent-dominated recovery processes (SDRPs) are not commonly used as commercial recovery processes to produce highly viscous oil. Solvent-dominated means that the injectant comprises greater than 50% by mass of solvent or that greater than 50% of the produced oil's viscosity reduction is obtained by chemical solvation rather than by thermal means. Highly viscous oils are produced primarily using thermal methods in which heat, typically in the form of steam, is added to the reservoir. Cyclic solvent-dominated recovery processes (CSDRPs) are a subset of SDRPs. A CSDRP is typically, but not necessarily, a non-thermal recovery method that uses a solvent to mobilize viscous oil by cycles of injection and production. One possible laboratory method for roughly comparing the relative contribution of heat and dilution to the viscosity reduction obtained in a proposed oil recovery process is to compare the viscosity obtained by diluting an oil sample with a solvent to the viscosity reduction obtained by heating the sample.

In a CSDRP, a viscosity-reducing solvent is injected through a well into a subterranean viscous-oil reservoir, causing the pressure to increase. Next, the pressure is lowered and reduced-viscosity oil is produced to the surface of the subterranean viscous-oil reservoir through the same well through which the solvent was injected. Multiple cycles of injection and production are used.

CSDRPs may be particularly attractive for thinner or lower-oil-saturation reservoirs. In such reservoirs, thermal methods utilizing heat to reduce viscous oil viscosity may be inefficient due to excessive heat loss to the overburden and/or underburden and/or reservoir with low oil content.

References describing specific CSDRPs include: Canadian Patent No. 2,349,234 (Lim et al.); G. B. Lim et al., "Three-dimensional Scaled Physical Modeling of Solvent Vapour Extraction of Cold Lake Bitumen", *The Journal of Canadian Petroleum Technology,* 35(4), pp. 32-40, April 1996; G. B. Lim et al., "Cyclic Stimulation of Cold Lake Oil Sand with Supercritical Ethane", *SPE Paper* 30298, 1995; U.S. Pat. No. 3,954,141 (Allen et al.); and M. Feali et al., "Feasibility Study of the Cyclic VAPEX Process for Low Permeable Carbonate Systems", *International Petroleum Technology Conference Paper* 12833, 2008.

The family of processes within the Lim et al. references describe a particular SDRP that is also a cyclic solvent-dominated recovery process (CSDRP). These processes relate to the recovery of heavy oil and bitumen from subterranean reservoirs using cyclic injection of a solvent in the liquid state which vaporizes upon production. The family of processes within the Lim et al. references may be referred to as CSP™ processes.

With reference to FIG. 1, which is a simplified diagram based on Canadian Patent No. 2,349,234 (Lim et al.), one CSP™ process is described as a single well method for cyclic solvent stimulation, the single well preferably having a horizontal wellbore portion and a perforated liner section. A vertical wellbore (1) driven through overburden (2) into reservoir (3) is connected to a horizontal wellbore portion (4). The horizontal wellbore portion (4) comprises a perforated liner section (5) and an inner bore (6). The horizontal wellbore portion comprises a downhole pump (7). In operation, solvent or viscosified solvent is driven down and diverted through the perforated liner section (5) where it percolates into reservoir (3) and penetrates reservoir material to yield a reservoir penetration zone (8). Oil dissolved in the solvent or viscosified solvent flows into the well and is pumped by downhole pump through an inner bore (6) through a motor at the wellhead (9) to a production tank (10) where oil and solvent are separated and the solvent is recycled.

SUMMARY

The present disclosure relates to the use of a cyclic solvent-dominated recovery process (CSDRP) to recover in-situ hydrocarbons including bitumen.

A cyclic solvent-dominated recovery process for recovering hydrocarbons from an underground reservoir may comprise (a) injecting injected fluid comprising greater than 50 mass % of a viscosity-reducing solvent into an injection well completed in the underground reservoir; (b) halting injection into the injection well and subsequently producing at least a fraction of the injected fluid and the hydrocarbons from the underground reservoir through a production well; (c) halting production through the production well; and (d) subsequently repeating the cycle of steps (a) to (c). Step (a) comprises, in at least one cycle, contacting uncovered hydrocarbons between solvent fingers by (a1) alternating injection of the injected fluid and production of at least a fraction of the injected fluid and the hydrocarbons to create an advance-retreat movement of the injected fluid.

The foregoing has broadly outlined the features of the present disclosure so that the detailed description that follows may be better understood. Additional features will also be described herein.

BRIEF DESCRIPTION OF THE DRAWINGS

These and other features, aspects and advantages of the disclosure will become apparent from the following description, appending claims and the accompanying drawings, which are briefly described below.

Figure 1:
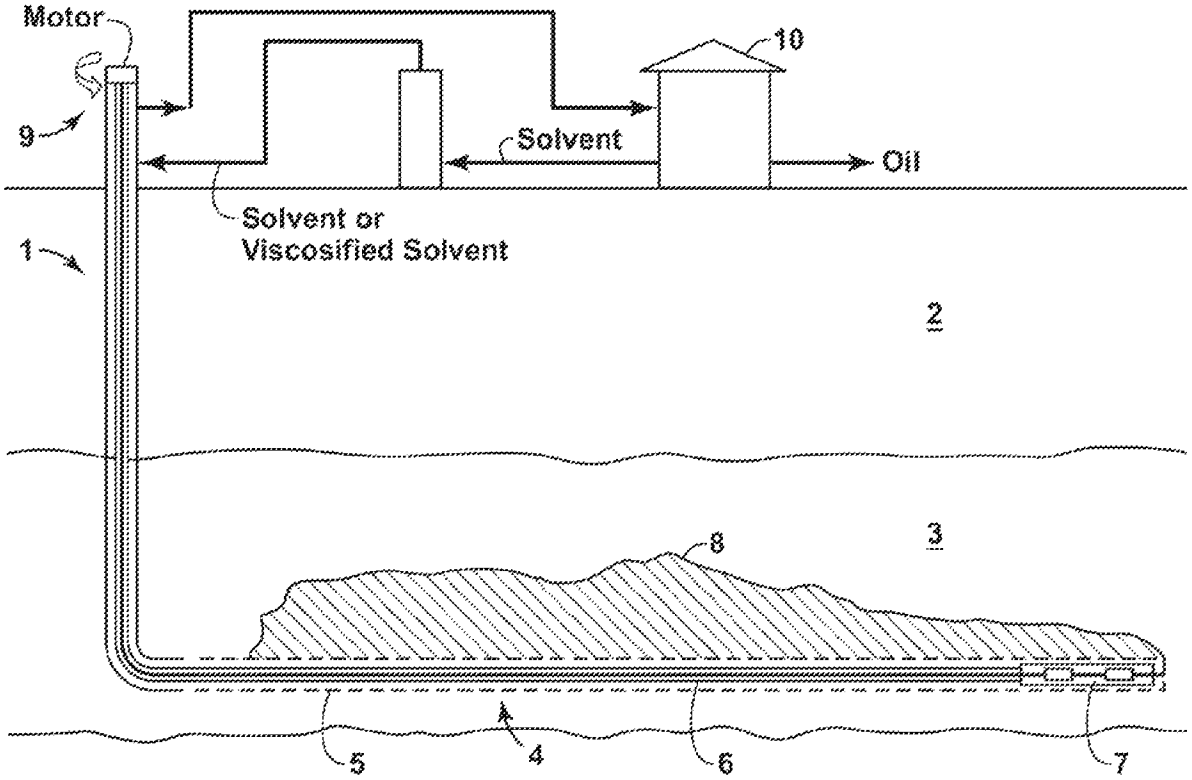
FIG. 1 (Prior Art)
FIG. 1 is a schematic of a CSP™ process in accordance with Canadian Patent No. 2,349,234 (Lim et al.).

It should be noted that the figures are merely examples and no limitations on the scope of the present disclosure are intended thereby. Further, the figures are generally not drawn to scale, but are drafted for purposes of convenience and clarity in illustrating various aspects of the disclosure.

DETAILED DESCRIPTION

The term "viscous oil" as used herein means a hydrocarbon, or mixture of hydrocarbons, that occurs naturally and that has a viscosity of at least 10 cP (centipoise) at initial reservoir conditions. Viscous oil includes oils generally defined as "heavy oil" or "bitumen". Bitumen is classified as an extra heavy oil, with an API gravity of about 10° or less, referring to its gravity as measured in degrees on the American Petroleum Institute (API) Scale. Heavy oil has an API gravity in the range of about 22.3° to about 10°. The terms viscous oil, heavy oil, and bitumen are used interchangeably herein since they may be extracted using similar processes.

In-situ is a Latin phrase for "in the place" and, in the context of hydrocarbon recovery, refers generally to a subsurface hydrocarbon-bearing reservoir. For example, in-situ temperature means the temperature within the reservoir. In another usage, an in-situ oil recovery technique is one that recovers oil from a reservoir within the earth.

The term "formation" as used herein refers to a subterranean body of rock that is distinct and continuous. The terms "reservoir" and "formation" may be used interchangeably.

During a CSDRP, a reservoir accommodates injected solvent and non-solvent fluid (also referred to as "additional injectants" or "non-solvent injectants") by compressing the pore fluids and, more importantly, by dilating the reservoir pore space when sufficient injection pressure is applied. Pore dilation is a particularly effective mechanism for permitting solvent to enter into reservoirs filled with viscous oils when the reservoir comprises largely unconsolidated sand grains. Injected solvent fingers into the oil sands and mixes with the viscous oil to yield a reduced viscosity mixture with significantly higher mobility than the native viscous oil. "Fingering" occurs when two fluids of different viscosities come in contact with one another and one fluid penetrates the other in a finger-like pattern, that is, in an uneven manner. Without intending to be bound by theory, the primary mixing mechanism is thought to be dispersive mixing, not diffusion. Preferably, injected fluid in each cycle replaces the volume of previously recovered fluid and then adds sufficient additional fluid to contact previously uncontacted viscous oil. The injected fluid may comprise greater than 50% by mass of solvent.

During production of the CSDRP process, pressure is reduced and the solvent(s), non-solvent injectant, and viscous oil flow back to the same well in which the solvent(s) and non-solvent injectant were injected and are produced to the surface of the reservoir as produced fluid. The produced fluid may be a mixture of the solvent and viscous oil. As the pressure in the reservoir falls, the produced fluid rate declines with time. Production of the produced fluid may be governed by any of the following mechanisms: gas drive via solvent vaporization and native gas exsolution, compaction drive as the reservoir dilation relaxes, fluid expansion, and gravity-driven flow. The relative importance of the mechanisms depends on static properties such as solvent properties, native GOR (Gas to Oil Ratio), fluid and rock compressibility characteristics, and/or reservoir depth. The relative importance of the mechanism may depend on operational practices such as solvent injection volume, producing pressure, and/or viscous oil recovery to-date, among other factors.

During an injection/production cycle, the volume of produced oil within the produced fluid should be above a minimum threshold to economically justify continuing the CSDRP. The produced oil within the produced fluid should also be recovered in an efficient manner. One measure of the efficiency of a CSDRP is the ratio of produced oil volume to injected solvent volume over a time interval, called the OISR (produced Oil to Injected Solvent Ratio). The time interval may be one complete injection/production cycle. The time interval may be from the beginning of first injection to the present or some other time interval. When the ratio falls below a certain threshold, further solvent injection may become uneconomic, indicating the solvent should be injected into a different well operating at a higher OISR. The exact OISR threshold depends on the relative price of viscous oil and solvent, among other factors. If either the oil production rate or the OISR becomes too low, the CSDRP may be discontinued. Even if oil rates are high and the solvent use is efficient, it is important to recover as much of the injected solvent as possible if it has economic value. Depending on the physical properties of the injected solvent, the remaining solvent may be recovered by producing to a low pressure to vaporize the solvent in the reservoir to aid its recovery. One measure of solvent recovery is the percentage of solvent recovered divided by the total injected. Rather than abandoning the well, another recovery process may be initiated. To maximize the economic return of a producing oil well, it is desirable to maintain an economic oil production rate and OISR as long as possible and then recover as much of the solvent as possible.

The OISR is one measure of solvent efficiency. Those skilled in the art will recognize that there are a multitude of other measures of solvent efficiency, such as the inverse of the OISR, or measures of solvent efficiency on a temporal basis that is different from the temporal basis discussed in this disclosure. Solvent recovery percentage is just one measure of solvent recovery. Those skilled in the art will recognize that there are many other measures of solvent recovery, such as the percentage loss, volume of unrecovered solvent per volume of recovered oil, or its inverse, the volume of produced oil to volume of lost solvent ratio (OLSR).

Solvent Storage Ratio (SSR) is a common measure of solvent efficiency. The SSR is a measure of the solvent fraction unrecovered from the reservoir divided by the in-situ oil produced from the reservoir. SSR is more explicitly defined as the ratio of the cumulative solvent injected into the reservoir minus the cumulative solvent produced from the reservoir to the cumulative in-situ oil produced from the reservoir. A lower SSR indicates lower solvent losses per volume of in-situ oil recovered, and thus, better total solvent recovery per volume of in-situ oil produced. A lower SSR would indicate an improvement in solvent efficiency.

As used herein, "improving solvent efficiency" means (a) improving the OISR, or (b) improving the SSR, or (c) improving both the OISR and the SSR.

Solvent Composition

The solvent may be a light, but condensable, hydrocarbon or mixture of hydrocarbons comprising ethane, propane, butane, or pentane. Additional injectants may include $CO_2$, natural gas, C5+ hydrocarbons, ketones, and alcohols. Non-solvent injectants may include steam, water, non-condensable gas, or hydrate inhibitors.

To reach a desired injection pressure when injecting the solvent, a viscosifer and/or a solvent slurry may be used in conjunction with the solvent. The viscosifer may be useful in adjusting solvent viscosity to reach desired injection pressures at available pump rates. The viscosifer may include diesel, viscous oil, bitumen, and/or diluent. The viscosifier may be in the liquid, gas, or solid phase. The viscosifer may be soluble in either one of the components of the injected solvent and water. The viscosifer may transition to the liquid phase in the reservoir before or during production. In the liquid phase, the viscosifers are less likely, to increase the viscosity of the produced fluids and/or decrease the effective permeability of the formation to the produced fluids.

The viscosifier may reduce the average distance the solvent travels from the well during an injection period. The viscosifer may act like a solvent and provide flow assurance near the wellbore and in the surface facilities in the event of asphaltene precipitation or solvent vaporization during shut-in periods. Solids suspended in the solvent slurry may comprise biodegradable solid particles, salt, water soluble solid particles, and/or solvent soluble solid particles.

The solvent may comprise greater than 50% C2-C5 hydrocarbons on a mass basis. The solvent may be primarily propane, optionally with diluent when it is desirable to adjust the properties of the injectant to improve performance. Alternatively, wells may be subjected to compositions other than these main solvents to improve well pattern performance, for example $CO_2$ flooding of a mature operation.

The solvent may be as described in Canadian Patent No. 2,645,267 (Chakraparty, issued Apr. 16, 2013). The solvent may comprise (i) a polar component, the polar component being a compound comprising a non-terminal carbonyl group; and (ii) a non-polar component, the non-polar component being a substantially aliphatic substantially non-halogenated alkane. The solvent may have a Hansen hydrogen bonding parameter of 0.3 to 1.7 (or 0.7 to 1.4). The solvent may have a volume ratio of the polar component to non-polar component of 10:90 to 50:50 (or 10:90 to 24:76, 20:80 to 40:60, 25:75 to 35:65, or 29:71 to 31:69). The polar component may be, for instance, a ketone or acetone. The non-polar component may be, for instance, a $C_2$-$C_7$ alkane, a $C_2$-$C_7$ n-alkane, an n-pentane, an n-heptane, or a gas plant condensate comprising alkanes, naphthenes, and aromatics.

The solvent may be as described in Canadian Patent Application No. 2,781,273 (Chakraparty, filed Jun. 28, 2012). The solvent may comprise (i) an ether with 2 to 8 carbon atoms; and (ii) a non-polar hydrocarbon with 2 to 30 carbon atoms. Ether may have 2 to 8 carbon atoms. Ether may be di-methyl ether, methyl ethyl ether, di-ethyl ether, methyl iso-propyl ether, methyl propyl ether, di-isopropyl ether, di-propyl ether, methyl iso-butyl ether, methyl butyl ether, ethyl iso-butyl ether, ethyl butyl ether, iso-propyl butyl ether, propyl butyl ether, di-isobutyl ether, or di-butyl ether. Ether may be di-methyl ether. The non-polar hydrocarbon may a $C_2$-$C_{30}$ alkane. The non-polar hydrocarbon may be a $C_2$-$C_5$ alkane. The non-polar hydrocarbon may be propane. The ether may be di-methyl ether and the hydrocarbon may be propane. The volume ratio of ether to non-polar hydrocarbon may be 10:90 to 90:10; 20:80 to 70:30; or 22.5:77.5 to 50:50.

Phase of Injected Solvent

The solvent may be injected into the well at a pressure in the underground reservoir above a liquid/vapor phase change pressure such that at least 25 mass % of the solvent enters the reservoir in the liquid phase. At least 50, 70, or even 90 mass % of the solvent may enter the reservoir in the liquid phase. The percentage of solvent that may enter the reservoir in a liquid phase may be within a range that includes or is bounded by any of the preceding examples. Injection of the solvent as a liquid may be preferred for achieving high pressures. When injecting the solvent as a liquid pore dilation at high pressures is thought to be a particularly effective mechanism for permitting the solvent to enter into reservoirs filled with viscous oils when the reservoir comprises largely unconsolidated sand grains. When injecting the solvent as a liquid, higher overall injection rates than injection as a gas may be allowed.

A fraction of the solvent may be injected in the solid phase in order to mitigate adverse solvent fingering, increase injection pressure, and/or keep the average distance of the solvent closer to the wellbore than in the case of pure liquid phase injection. Less than 20 mass % of the injectant may enter the reservoir in the solid phase. Less than 10 mass % or less than 50 mass % of the solvent may enter the reservoir in the solid phase. The percentage of solvent that may enter the reservoir in a solid phase may be within a range that includes or is bounded by any of the preceding examples. Once in the reservoir, the solid phase of the solvent may transition to a liquid phase before or during production to prevent or mitigate reservoir permeability reduction during production.

Injection of the solvent as a vapor may enable more uniform solvent distribution along a horizontal well, particularly when variable injection rates are targeted. Vapor injection in a horizontal well may also facilitate an upsize in the port size of installed inflow control devices (ICDs) that minimizes the risk of plugging the ICDs. Injecting the solvent as a vapor may increase the ability to pressurize the reservoir to a desired pressure by lowering effective permeability of the injected vapor in a formation comprising liquid viscous oil.

The solvent volume may be injected into the well at rates and pressures such that immediately after completing injection into the injection well during an injection period at least 25 mass % of the injected solvent is in a liquid state in the reservoir (e.g., underground).

A non-condensable gas may be injected into the reservoir to achieve a desired pressure, followed by injection of the solvent. Alternating periods of a primarily non-condensable gas with primarily solvent injection may provide a way to maintain the desired injection pressure target. The primarily gas injection period may offset the pressure leak off observed during primarily solvent injection to reestablish the desired injection pressure. The alternating strategy of condensable gas to solvent injection periods may result in non-condensable gas accumulations in the previous established solvent pathways. The accumulation of non-condensable gas may divert the subsequent primarily solvent injection to bypassed viscous oil thereby increasing the mixing of solvent and oil in the producing well's drainage area.

A non-solvent injectant in the vapor phase, such as $CO_2$ or natural gas, may be injected, followed by injection of a solvent. Depending on the pressure of the reservoir, it may be desirable to significantly heat the solvent in order to inject it as a vapor. Heating of injected vapor or liquid solvent may enhance production through mechanisms described by "Boberg, T. C. and Lantz, R. B., "Calculation of the production of a thermally stimulated well", *JPT*, 1613-1623, December 1966. Towards the end of the injection period, a portion of the injected solvent, perhaps 25% or more, may become a liquid as pressure rises. After the targeted injection cycle volume of solvent is achieved, no special effort is made to maintain the injection pressure at the saturation conditions of the solvent, and liquefaction would occur through pressurization, not condensation. Downhole pressure gauges and/or reservoir simulation may be used to estimate the phase of the solvent and non-solvent injectants at downhole conditions and in the reservoir. A reservoir simulation may be carried out using a reservoir simulator, a software program for mathematically modeling the phase and flow behavior of fluids in an underground reservoir. Those skilled in the art understand how to use a reservoir simulator to determine if 25% of the solvent would be in the liquid phase immediately after the completion of an injection period. Those skilled in the art may rely on measurements recorded using a downhole pressure gauge in order to increase the accuracy of a reservoir simulator. Alternatively, the downhole pressure gauge measurements may be used to directly make the determination without the use of reservoir simulation.

Although preferably a CSDRP is predominantly a non-thermal process in that heat is not used principally to reduce the viscosity of the viscous oil, the use of heat is not excluded. Heating may be beneficial to improve performance, improve process start-up, or provide flow assurance during production. For start-up, low-level heating (for example, less than 100° C.) may be appropriate. Low-level heating of the solvent prior to injection may also be performed to prevent hydrate formation in tubulars and in the reservoir. Heating to higher temperatures may benefit recovery. Two non-exclusive scenarios of injecting a heated solvent are as follows. In one scenario, vapor solvent would be injected and would condense before it reaches the bitumen. In another scenario, a vapor solvent would be injected at up to 200° C. and would become a supercritical fluid at downhole operating pressure.

Pore Volume

Pore volume is discussed herein because it will be referred to below with respect to advance-retreat injection and production volumes.

As described in Canadian Patent No. 2,734,170 (Dawson et al., issued Sep. 24, 2013), one method of managing fluid injection in a CSDRP is for the cumulative volume injected over all injection periods in a given cycle to equal the net reservoir voidage resulting from previous injection and production cycles plus an additional volume, for example approximately 2-15%, or approximately 3-8% of the pore volume (PV) of the reservoir volume associated with the well pattern. In mathematical terms, the volume may be represented by:

$$V_{INJECTANT}=V_{VOIDAGE}+V_{ADDITIONAL}.$$

One way to approximate the net in-situ volume of fluids produced is to determine the total volume of non-solvent liquid hydrocarbon fractions and aqueous fractions produced minus the net injectant fractions produced. For example, in the case where 100% of the injectant is solvent and the reservoir contains only oil and water, an equation that represents the net in-situ volume of fluids produced is:

$$V_{VOIDAGE}=V_{OIL}^{PRODUCED}+V_{WATER}^{PRODUCED}-(V_{SOLVENT}^{INJECTED}-V_{SOLVENT}^{PRODUCED}).$$

Estimates of the PV are the reservoir volume inside a unit cell of a repeating well pattern or the reservoir volume inside a minimum convex perimeter defined around a set of wells in a given cycle. Fluid volume may be calculated at in-situ conditions, which take into account reservoir temperatures and pressures. If the application is for a single well, the "pore volume of the reservoir" is defined by an inferred drainage radius region around the well which is approximately equal to the distance that solvent fingers are expected to travel during the injection cycle (for example, about 30-200 m). Such a distance may be estimated by reservoir surveillance activities, reservoir simulation or reference to prior observed field performance. In this approach, the pore volume may be estimated by direct calculation using the estimated distance, and injection ceased when the associated injection volume (2-15% PV) has been reached.

As described in the aforementioned Canadian Patent No. 2,734,170, rather than measuring pore volume directly, indirect measurements can be made of other parameters and used as a proxy for pore volume.

Advance-Retreat Movement

Where a low-viscosity solvent contacts high-viscosity hydrocarbons, solvent fingers may form, extending into the hydrocarbons. Such fingers may leave unrecovered hydrocarbons between the fingers, which may lead to poor sweep or conformance, and hence lesser recovery. The instant process seeks to contact areas between the solvent fingers of unrecovered hydrocarbons with solvent.

In at least one cycle, the injection involves contacting uncovered hydrocarbons between solvent fingers by (a1) alternating injection of the injected fluid and production of at least a fraction of the injected fluid and the hydrocarbons, for creating to create an advance-retreat movement of the injected fluid, for contacting uncovered hydrocarbons between solvent fingers.

As used herein, "advance-retreat movement" is movement towards unrecovered hydrocarbons. The movement towards unrecovered hydrocarbons is a movement in a direction generally opposite to the direction in which recovered hydrocarbons flow. Recovered hydrocarbons flow toward the well/wellbore. A non-limiting generally two dimensional visual analogy is water lapping onto a beach, but where the water moves up the beach continuing to reach more and more dry sand.

Whereas the aforementioned Canadian Patent No. 2,734,170 uses periods of restricted injection, neither production nor advance-retreat movements are contemplated within the injection portion of the cycles.

The aforementioned Canadian Patent No. 2,645,267 does not describe production or advance-retreat movements within the injection portion of the cycles.

A cyclic solvent-dominated recovery process for recovering hydrocarbons from an underground reservoir as disclosed herein comprises (a) injecting injected fluid comprising greater than 50 mass % of a viscosity-reducing solvent into an injection well completed in the underground reservoir; (b) halting injection into the injection well and subsequently producing at least a fraction of the injected fluid and the hydrocarbons from the underground reservoir through a production well; (c) halting production through the production well; and (d) repeating the cycle of steps (a) to (c). Step (a) comprises, in at least one cycle, (a1) alternating injection of the fluid and production of at least a fraction of the injected fluid and the hydrocarbons, for creating an advance-retreat movement of the injected fluid, for contacting uncovered hydrocarbons between solvent fingers.

For the purposes of explaining this process, a non-limiting theoretical numerical example will be used. The units of volume will be expressed in terms of pore volume (PV) around the injection well within which solvent fingers are expected to travel during the cycle, with 1 PV representing 100% of the estimated pore volume. As discussed in the aforementioned Canadian Patent No. 2,734,170, a CSDRP may be operated where each injection cycle injects a volume of fluid equal to the estimated pore volume plus 2-15% (or 3-8%), in order to reach unrecovered hydrocarbons. Therefore, using PV units, an injection cycle may inject 1.02-1.15

PV per cycle (1.05 PV for the purposes of this example). However, this 1.05 PV is not injected as one injection period as would be done conventionally; rather, a total volume of 1.05 PV is injected using alternating injection and production for creating an advance-retreat movement of the fluid. For instance, 0.51 PV is injected. Then, in order to effect the "retreat", production is effected. The amount of production need only be above 0 PV since any production will cause a retreat. In this example, 0.005 PV is produced. Next, an amount above 0.005 PV, for instance, 0.1 PV, is injected. In this way, the "advance" movement will be achieved and the injected fluid will reach further into the reservoir. This alternating injection and production continues until the desired injection volume has been injected, for instance, 1.05 PV. Next, conventional production is effected. In another example, after 0.51 PV is injected, alternating steps of 0.02 PV production and 0.03 PV injection are performed. The injection and production volumes should be such that there is net solvent injection in order to reach new hydrocarbons. Again, nothing should be read as limiting in this theoretical example which is merely provided for the purposes of illustrating at a high level, one manner of operating the process.

Step (a1) may be performed in a given injection (a) at some point after 50% of pore volume has been injected, or after a 25% of pore volume has been injected. That is, the first 0.25 PV or 0.50 PV may be injected by conventional injection. A later cycle has a larger pore volume than an earlier cycle since a later cycle penetrates further into the reservoir. Accordingly, beginning step (a1) at the, say, 0.75 PV point in two cycles (an earlier cycle and a later cycle) would mean that the later cycle injects a larger volume of injected fluid than the earlier cycle using conventional injection. In other words, step (a1) may be started in later cycles after a larger volume of injected fluid is injected, as compared to earlier cycles. This is consistent with using the advance-retreat movement near the recovery front in the reservoir.

The alternating injection and production for creating advance-retreat movement of the fluid may involve small volumes as compared to pore volume (1 PV) and as compared to what is conventionally injected continuously (for instance, 1.02-1.15 PV) or produced continuously. Examples of such volumes are provided in the following two paragraphs.

Production volume in (a1) may be less than 25% of production volume in (c) in a given cycle (a) to (c), or less than 10%, or less than 5%, and/or more than 1%. Using another comparison, for instance, production volume in (a1) may be less than 50% of pore volume in a given cycle (a) to (c), or less than 25%, or less than 10%, and/or more than 2%. The production volume percentage may be within a range that includes or is bounded by any of the preceding examples. As used in this context, "production volume" refers to a sum of all of the production volumes during the advance-retreat movement.

Using yet another comparison, for instance, an alternating injection of (a1) may have a volume of less than 25% of the pore volume, or less than 10%, or less than 5%, and/or more than 0.1%. Using still another comparison, for instance, an alternating production of (a1) may have a volume of less than 10% of the pore volume, or less than 5%, or less than 1%, and/or more than 0.1%. The pore volume percentage may be within a range that includes or is bounded by any of the preceding examples. As used in this context, an alternating production means one of the plurality of production periods during advance-retreat movement. Likewise, an alternating injection means one of the plurality of injection periods during advance-retreat movement.

To further explain volume calculations, in a given cycle, if 0.50 PV is the first injection, followed by alternating periods of 0.01 PV production, and 0.02 PV injection, followed by conventional production, the 0.50 PV and the convention production are excluded from volume calculations for the purpose of injection and production volumes (whether individual or summed), which are based solely on the 0.01 PV production and 0.02 PV injection periods, individual or summed, as appropriate. The step (a1) may be performed after a first cycle (a) to (c). That is, conventional injection may be used in the first cycle (a) to (c), and in subsequent cycles (a) to (c), advance-retreat movement may be used. Likewise, the first two, three, or another number of initial cycles may use convention injection before employing advance-retreat.

The step (a1) may be used in a second half of total cycles (d) in terms of injection volume. That is, initial cycle(s) (d) may use conventional injection until at least half of the total injection volume has been injected at which point advance-retreat is employed.

The advance-retreat movement of the fluid may be achieved by adjusting injection and production pumps speeds.

At least 5 or at least 20 advance-retreat cycles may be used.

Example

A Cold Lake Alberta bitumen saturated sand pack (7 Darcy sand pack, which is a 462 mm in length and 57 mm in ID (inside diameter) lead sleeve subjected to a confining pressure by brine of 8.0 MPag in the annulus between the sleeve and the stainless steel outer shell, and flooded with brine and then with bitumen) was flooded with 2.3 PV (pore volume) of a first solvent (a blend of 22.5 vol % dimethyl ether and 77.5 vol % C3 at room temperature) at 21° C. at a constant rate of 2.73 ml/min. The temperature of the sand pack was then raised to 60° C. and 1.0 PV of the first solvent was injected at a constant rate of 2.73 ml/min and with a confining pressure of 6.3 MPag. Then, 0.5 PV of a second solvent (a blend of 30 vol % acetone and 70 vol % C3 at room temperature) was injected at a constant rate of 2.73 ml/min and a sand pack temperature of 60° C. The confining pressure during this second solvent injection was 4.6 MPag. The density of the produced fluids monitored continuously during this steady injection and production, according to conventional injection, was relatively low at 480 to 498 $kg/m^3$, indicating very little access to unaccessed bitumen. The produced oil, after solvent removal, was light-brown compared to the original bitumen that was dark black, indicating the solvent was not contacting any new oil. After 0.5 PV of the conventional injection and production at constant rate, advance-retreat movements were applied to the sand pack by varying the pressure at the production end between 2.5 and 5.2 MPag every five minutes during 0.5 PV volume of the second solvent injection at the same constant rate of 2.73 ml/min as in the conventional injection with the second solvent, with a confining pressure that varied between 4.4 MPag and 6.4 MPag with advance-retreat movements. The density during the advance-retreat movements period increased from 498 $kg/m^3$ at the start to 566 $kg/m^3$ at the end and stayed high when the test was terminated. An increase in density of the produced fluids for the same solvent injection rate was an indication of more oil being recovered. The produced oil after the solvent removal was as dark as the initial bitumen—indicating accessing of previously unreached oil. The uplift in oil production over the known injection was close to 25%. It is important to note that this example uses a fixed pore volume for the entire sand pack for simplicity. However, in the discussions above, pore volume changes from cycle to cycle (i.e. pore volume increases as the cycle number increases). The results of this example are presented in Table 1 and FIG. 2.

TABLE 1

Results of the Example.

| Injected solvent volume (ml) | Injected solvent as a fraction of pore volume | Density (kg/m3) |
|---|---|---|
| 42.29 | 0.0879 | 488.1 |
| 57.37 | 0.1192 | 487.2 |
| 69.44 | 0.1443 | 486.5 |
| 80.11 | 0.1665 | 481.7 |
| 97.00 | 0.2016 | 479.8 |
| 110.3 | 0.2293 | 480.5 |
| 126.3 | 0.2625 | 492.8 |
| 139.3 | 0.2895 | 493.9 |
| 152.2 | 0.3163 | 493.3 |
| 165.5 | 0.3439 | 492.3 |
| 179.6 | 0.3732 | 491.3 |
| 192.1 | 0.3993 | 490.4 |
| 206.4 | 0.4289 | 489.4 |
| 233.4 | 0.4850 | 488.2 |

TABLE 1-continued

Results of the Example.

| Injected solvent volume (ml) | Injected solvent as a fraction of pore volume | Density (kg/m3) |
|---|---|---|
| 240.6* | 0.5000 | 498.0 |
| 256.9 | 0.5339 | 500.4 |
| 282.7 | 0.5875 | 489.6 |
| 309.5 | 0.6432 | 499.8 |
| 324.6 | 0.6745 | 514.1 |
| 350.0 | 0.7273 | 535.0 |
| 363.8 | 0.7560 | 536.9 |
| 387.2 | 0.8046 | 552.6 |
| 406.8 | 0.8454 | 552.0 |
| 423.9 | 0.8809 | 561.5 |
| 437.9 | 0.9100 | 557.5 |
| 451.2 | 0.9377 | 565.5 |
| 464.9 | 0.9661 | 558.5 |
| 481.2 | 1.0000 | 565.2 |

*The point at which the injection type was changed to an advance-retreat mode.

Figure 2:
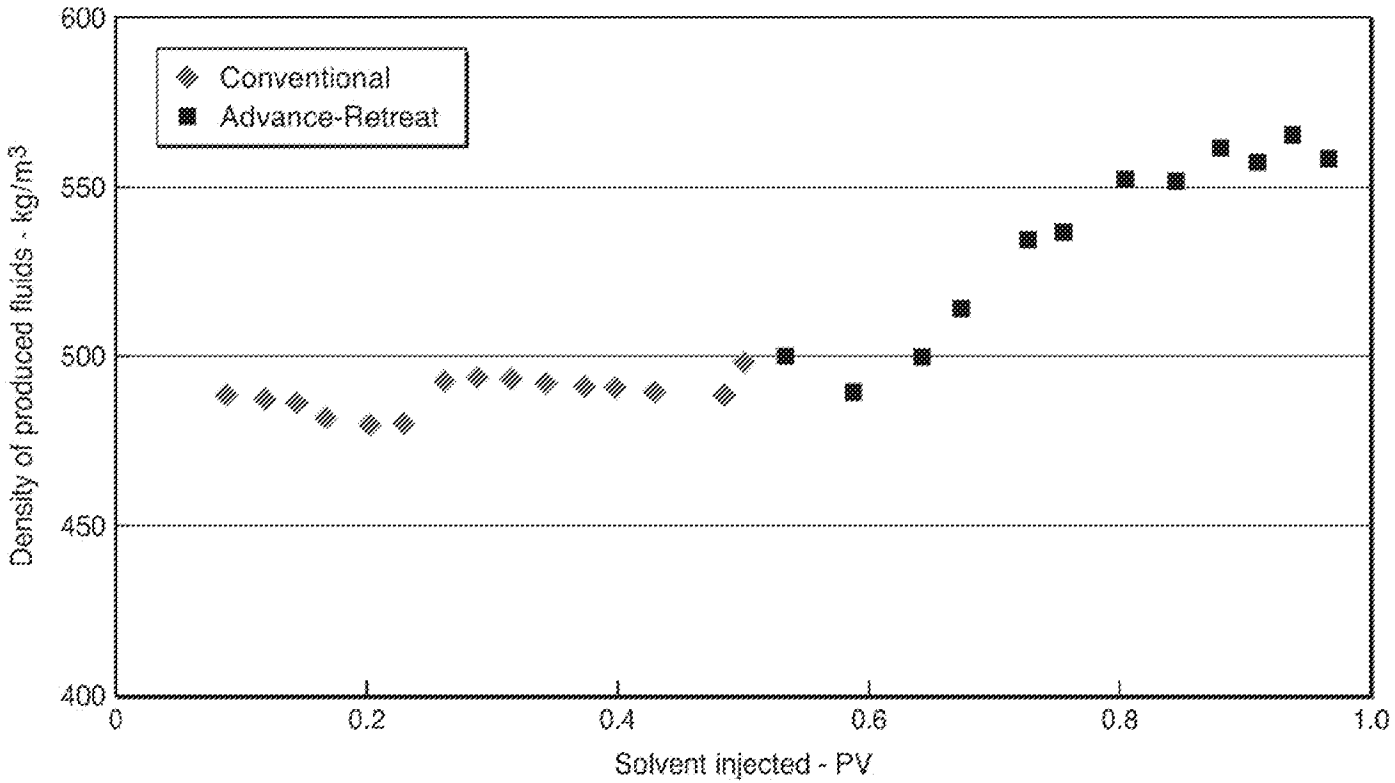
FIG. 2 is a graph illustrating experimental results.

In FIG. 2, the diamond shaped data points represent conventional injection and the square data points represent an advance-retreat mode.

Table 2 outlines the operating ranges for certain CSDRPs. The present disclosure is not intended to be limited by such operating ranges.

TABLE 2

Operating Ranges for a CSDRP.

| Parameter | Broader Option | Narrower Option |
|---|---|---|
| Cumulative injectant volume per cycle | Fill-up estimated pattern pore volume plus a cumulative 3-8% of estimated pattern pore volume; or inject, beyond a primary pressure threshold, for a cumulative period of time (e.g. days to months); or inject, beyond a primary pressure threshold, a cumulative of 3-8% of estimated pore volume. | Inject a cumulative volume in a cycle, beyond a primary pressure threshold, of 3-8% of estimated pore volume. |
| Injectant composition, main | Main solvent (>50 mass %) $C_2$-$C_5$. Alternatively, wells may be subjected to compositions other than main solvents to improve well pattern performance (i.e. $CO_2$ flooding of a mature operation or altering in-situ stress of reservoir). $CO_2$ | Main solvent (>50 mass %) is propane ($C_3$). |
| Injectant composition, additive | Additional injectants may include $CO_2$ (up to about 30 mass %), $C_{3+}$, viscosifiers (e.g. diesel, viscous oil, bitumen, diluent), ketones, alcohols, sulphur dioxide, hydrate inhibitors, steam, non-condensable gas, bio-degradable solid particles, salt, water soluble solid particles, or solvent soluble solid particles. | Only diluent, and only when needed to achieve adequate injection pressure. Or, a polar compound having a non-terminal carbonyl group (e.g. a ketone, for instance acetone). |
| Injectant phase & Injection pressure | Solvent injected such that at the end of the injection cycle, greater than 25% by mass of the solvent exists as a liquid and less than 50% by mass of the injectant exists in the solid phase in the reservoir, with no constraint as to whether most solvent is injected above or below dilation pressure or fracture pressure. | Solvent injected as a liquid, and most solvent injected just under fracture pressure and above dilation pressure, $P_{fracture} > P_{injection} > P_{dilation} > P_{vaporP}$. |

TABLE 2-continued

Operating Ranges for a CSDRP.

| Parameter | Broader Option | Narrower Option |
|---|---|---|
| Injectant temperature | Enough heat to prevent hydrates and locally enhance wellbore inflow consistent with Boberg-Lantz mode | Enough heat to prevent hydrates with a safety margin, $T_{hydrate}$ + 5° C. to $T_{hydrate}$ + 50° C. |
| Injection rate during continuous injection | 0.1 to 10 $m^3$/day per meter of completed well length (rate expressed as volumes of liquid solvent at reservoir conditions). | 0.2 to 6 $m^3$/day per meter of completed well length (rate expressed as volumes of liquid solvent at reservoir conditions). Rates may also be designed to allow for limited or controlled fracture extent, at fracture pressure or desired solvent conformance depending on reservoir properties. |
| Primary threshold pressure (pressure at which solvent continues to be injected for either a period of time or in a volume amount) | Any pressure above initial reservoir pressure. | A pressure between 90% and 100% of fracture pressure. |
| Secondary threshold pressure (pressure to maintain or exceed during a restriction duration) | Any pressure above initial reservoir pressure. | Within 6 MPa of, but less than, the primary threshold pressure |
| Well length | As long of a horizontal well as can practically be drilled; or the entire pay thickness for vertical wells. | 500 m-1500 m (commercial well). |
| Well configuration | Horizontal wells parallel to each other, separated by some regular spacing of 60-600 m. Also vertical wells, high angle slant wells & multi-lateral wells. Also infill injection and/or production wells (of any type above) targeting bypassed hydrocarbon from surveillance of pattern performance. | Horizontal wells parallel to each other, separated by some regular spacing of 60-320 m. |
| Well orientation | Orientated in any direction. | Horizontal wells orientated perpendicular to (or with less than 30 degrees of variation) the direction of maximum horizontal in-situ stress. |
| Minimum producing pressure (MPP) | Generally, the range of the MPP should be, on the low end, a pressure significantly below the vapor pressure, ensuring vaporization; and, on the high-end, a high pressure near the native reservoir pressure. For example, perhaps 0.1 MPa-5 MPa, depending on depth and mode of operation (all-liquid or limited vaporization). | A low pressure below the vapor pressure of the main solvent, ensuring vaporization, or, in the limited vaporization scheme, a high pressure above the vapor pressure. At 500 m depth with pure propane, 0.5 MPa (low)-1.5 MPa (high), values that bound the 800 kPa vapor pressure of propane. |
| Oil rate | Switch to injection when rate equals 2 to 50% of the max rate obtained during the cycle; Alternatively, switch when absolute rate equals a pre-set value. Alternatively, well is unable to sustain hydrocarbon flow (continuous or intermittent) by primary production against backpressure of gathering system or well is "pumped off" unable to sustain flow from artificial lift. Alternatively, well is out of sync with adjacent well cycles. | Switch when the instantaneous oil rate declines below the calendar day oil rate (CDOR) (e.g. total oil/total cycle length). Likely most economically optimal when the oil rate is at about 0.8 × CDOR. Alternatively, switch to injection when rate equals 20-40% of the max rate obtained during the cycle. |
| Gas rate | Switch to injection when gas rate exceeds the capacity of the pumping or gas venting system. Well is unable to sustain | Switch to injection when gas rate exceeds the capacity of the pumping or gas venting system. During production, an optimal |

TABLE 2-continued

Operating Ranges for a CSDRP.

| Parameter | Broader Option | Narrower Option |
|---|---|---|
| | hydrocarbon flow (continuous or intermittent) by primary production against backpressure of gathering system with/or without compression facilities. | strategy is one that limits gas production and maximizes liquid from a horizontal well. |
| Oil to Solvent Ratio | Begin another cycle if the OISR of the just completed cycle is above 0.15 or economic threshold. | Begin another cycle if the OISR of the just completed cycle is above 0.3. |
| Abandonment pressure (pressure at which well is produced after CSDRP cycles are completed) | Atmospheric or a value at which all of the solvent is vaporized. | For propane and a depth of 500 m, about 340 kPa, the likely lowest obtainable bottomhole pressure at the operating depth and well below the value at which all of the propane is vaporized. |

In Table 2, the options may be formed by combining two or more parameters and, for brevity and clarity, each of these combinations will not be individually listed.

In the context of this specification, diluent means a liquid compound that can be used to dilute the solvent and can be used to manipulate the viscosity of any resulting solvent-bitumen mixture. By such manipulation of the viscosity of the solvent-bitumen (and diluent) mixture, the invasion, mobility, and distribution of solvent in the reservoir can be controlled so as to increase viscous oil production.

The diluent is typically a viscous hydrocarbon liquid, especially a $C_4$ to $C_{20}$ hydrocarbon, or mixture thereof, is commonly locally produced and is typically used to thin bitumen to pipeline specifications. Pentane, hexane, and heptane are commonly components of such diluents. Bitumen itself can be used to modify the viscosity of the injected fluid, often in conjunction with ethane solvent.

The diluent may have an average initial boiling point close to the boiling point of pentane (36° C.) or hexane (69° C.) though the average boiling point (defined further below) may change with reuse as the mix changes (some of the solvent originating among the recovered viscous oil fractions). Preferably, more than 50% by weight of the diluent has an average boiling point lower than the boiling point of decane (174° C.). More preferably, more than 75% by weight, especially more than 80% by weight, and particularly more than 90% by weight of the diluent, has an average boiling point between the boiling point of pentane and the boiling point of decane. The diluent may have an average boiling point close to the boiling point of hexane (69° C.) or heptane (98° C.), or even water (100° C.).

More than 50% by weight of the diluent (particularly more than 75% or 80% by weight and especially more than 90% by weight) has a boiling point between the boiling points of pentane and decane. More than 50% by weight of the diluent has a boiling point between the boiling points of hexane (69° C.) and nonane (151° C.), particularly between the boiling points of heptane (98° C.) and octane (126° C.).

By average boiling point of the diluent, we mean the boiling point of the diluent remaining after half (by weight) of a starting amount of diluent has been boiled off as defined by ASTM D 2887 (1997), for example. The average boiling point can be determined by gas chromatographic methods or more tediously by distillation. Boiling points are defined as the boiling points at atmospheric pressure.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numeral ranges provided. Accordingly, these terms should be interpreted as indicating insubstantial or inconsequential modifications or alterations of the subject matter described and are considered to be within the scope of the disclosure.

It should be understood that numerous changes, modifications, and alternatives to the preceding disclosure can be made without departing from the scope of the disclosure. The preceding description, therefore, is not meant to limit the scope of the disclosure. Rather, the scope of the disclosure is to be determined only by the appended claims and their equivalents. It is also contemplated that structures and features in the present examples can be altered, rearranged, substituted, deleted, duplicated, combined, or added to each other.

The articles "the", "a" and "an" are not necessarily limited to mean only one, but rather are inclusive and open ended so as to include, optionally, multiple such elements.

The invention claimed is:

1. A cyclic solvent-dominated recovery process for recovering hydrocarbons from an underground reservoir, the cyclic solvent-dominated recovery process comprising:

(a) injecting injected fluid comprising greater than 50 mass % of a viscosity-reducing solvent into an injection well completed in the underground reservoir;

(b) halting injection into the injection well and subsequently producing at least a fraction of the injected fluid and the hydrocarbons from the underground reservoir through a production well;

(c) halting production through the production well; and (d) repeating the cycle of steps (a) to (c);

wherein step (a) comprises, in at least one cycle, contacting uncovered hydrocarbons between solvent fingers by (a1) alternating injection of the injected fluid and production of at least a fraction of the injected fluid and the hydrocarbons to create an advance-retreat movement of the injected fluid; and wherein (a1) is performed in a given injection (a) at some point after 25% of pore volume has been injected and production volume in (a1) is less than 25% of production volume in (c) in a given cycle (a) to (c).

2. The process of claim 1, wherein production volume in (a1) is more than 1% of production volume in (c) in a given cycle (a) to (c).

3. The process of claim 1, wherein production volume in (a1) is less than 50% of pore volume in a given cycle (a) to (c).

4. The process of claim 3, wherein production volume in (a1) is more than 2% of the pore volume in (c) in a given cycle (a) to (c).

5. The process of claim 1, wherein the alternating injection of the injected fluid has a volume of less than 25% of pore volume.

6. The process of claim 5, wherein the alternating injection of the injected fluid has a volume of more than 0.1% of the pore volume.

7. The process of claim 1, wherein the alternating production of the injected fluid has a volume of less than 10% of pore volume.

8. The process of claim 7, wherein the alternating production of the injected fluid has a volume of more than 0.1% of the pore volume.

9. The process of claim 1, wherein (a1) is performed in a second half of total cycles (d) in terms of injection volume.

10. The process of claim 1, wherein (a1) comprises at least five advance-retreat cycles of injection and production.

11. The process of claim 1, wherein the hydrocarbons are a viscous oil having a viscosity of at least 10 cP at initial reservoir conditions.

12. The process of claim 1, wherein the viscosity-reducing solvent comprises, ethane, propane, butane, pentane, carbon dioxide, or a combination thereof.

13. The process of claim 1, wherein the injected fluid comprises at least 25 mass % liquid at the end of an injection cycle.

* * * * *